US005470296A

United States Patent [19]

Welte

[11] Patent Number: 5,470,296

[45] Date of Patent: Nov. 28, 1995

[54] SPORT JUMP APPARATUS

[76] Inventor: David C. Welte, 4420 Highway 63 South, Rochester, Minn. 55904

[21] Appl. No.: 259,486

[22] Filed: Jun. 14, 1994

[51] Int. Cl.[6] ..... A63B 5/22

[52] U.S. Cl. ..... 482/81; 482/79

[58] Field of Search ..... 482/81, 79, 33; 273/185 D, 196, 197 R, 26 E, 58 C; 239/237, 239, 240

[56] References Cited

U.S. PATENT DOCUMENTS

| | | | |
|---|---|---|---|
| 956,838 | 5/1910 | Treanor . | |
| 2,509,576 | 5/1950 | Morgan | 239/240 |
| 3,099,393 | 7/1963 | Lent | 239/240 |
| 3,241,832 | 3/1966 | Miller . | |
| 3,589,718 | 6/1971 | Bessler . | |
| 3,589,719 | 6/1971 | Glass et al. . | |
| 3,589,719 | 6/1971 | Glass et al. | 482/81 |
| 3,610,616 | 10/1971 | Evans | 482/81 |
| 3,797,825 | 3/1974 | Barrett . | |
| 4,124,206 | 11/1978 | Price | 482/81 |
| 4,487,368 | 12/1984 | Clearman | 239/237 |
| 4,739,985 | 4/1988 | Rudell et al. | 482/81 |
| 4,813,665 | 3/1989 | Carr . | |
| 5,167,599 | 12/1992 | Haller . | |

*Primary Examiner*—Richard J. Apley
*Assistant Examiner*—Lynne A. Reichard
*Attorney, Agent, or Firm*—Palmatier, Sjoquist & Helget

[57] ABSTRACT

A sport jump apparatus is disclosed that provides variably paced aerobic and anaerobic exercise. The apparatus has a drive unit with a rotating shaft mounted on a support base. The shaft is positioned at an oblique angle with respect to the floor. A resilient rod is connected to the rotating shaft at an oblique angle to the shaft whereby the rod rotates in a conical configuration. As part of the conical configuration, the rod rotates through a substantially horizontal position at which point an individual jumps over the moving rod. Variable speed control adjusts the pacing of the rotation of the rod.

15 Claims, 4 Drawing Sheets

SPORT JUMP APPARATUS

BACKGROUND OF THE INVENTION

This invention relates to exercise equipment. More particularly, it relates to a variably paced jumping apparatus.

The use of a jump rope for exercising has been very popular for many years. A disadvantage of using a jump rope is that it requires a significant amount of vertical space to allow the rope to pass over the user's head. Additionally, the use of a jump rope requires a fair amount of coordination of the hands to properly swing the rope. Errors in swinging the rope disrupts the continuity of the exercise resulting in a less efficient exercise session. Moreover, as a workout with a jump rope progresses, the user tires and errors and disruptions in the exercise routine are more likely to occur. Frustration over the disruptions can cause the individual to cut short an exercise session.

SUMMARY OF THE INVENTION

A sport jump apparatus is disclosed that provides variably paced aerobic and anaerobic exercise. The apparatus has a drive unit with a rotating shaft mounted on a support base. The shaft is positioned at an oblique angle with respect to the floor. A resilient rod is connected to the rotating shaft at an oblique angle to the shaft whereby the rod rotates in a conical configuration. As part of the conical configuration, the rod rotates through a substantially horizontal position at which point an individual jumps over the moving rod. A variable speed control adjusts the pacing of the rotation of the rod.

An object and advantage of the invention is that an improved paced aerobic and anaerobic exercise apparatus is provided which eliminates the need of a jump rope.

An additional object and advantage of the invention is that the apparatus may be utilized in a space smaller than that required for a conventional jump rope. Moreover, a minimal amount of floor space and vertical space is required for the apparatus.

An additional object and advantage of the invention is that the pace of the rotation of the rod may be adjusted as desired by the individual and may be adjusted during the jumping exercise.

An additional object and advantage of the invention is that the motion of the rod is achieved with a minimal number of mechanical parts and with a compact apparatus.

A further object and advantage of the invention is that the use is not dependant upon the hand-eye coordination of the user. Moreover, a missed jump does not disrupt the exercise routine or the operation of the apparatus. The rod either flexes as it strikes the individual or the slip clutch allows slippage of the rod with respect to the rotating shaft. The apparatus continues to operate and the exercise routine is not disrupted as it would be with a conventional jump rope.

A further object and advantage of the invention is that during exercise, the device permits other exercises to be simultaneously performed with the arms such as boxing or free weights.

DETAILED DESCRIPTION OF THE PREFERRED EMBODIMENT

Figure 1:
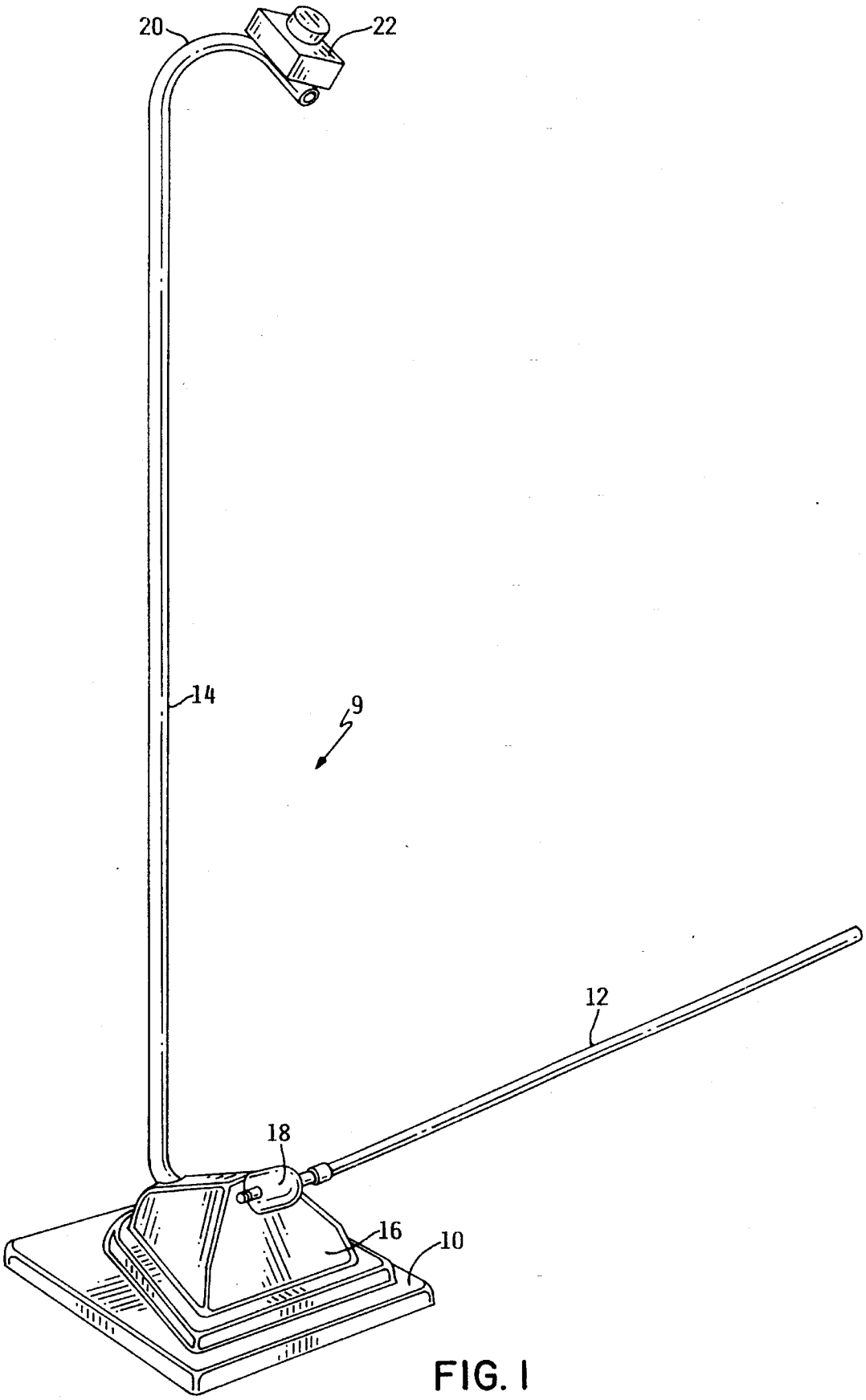
FIG. 1 shows a front perspective view of the apparatus.
Figure 2:
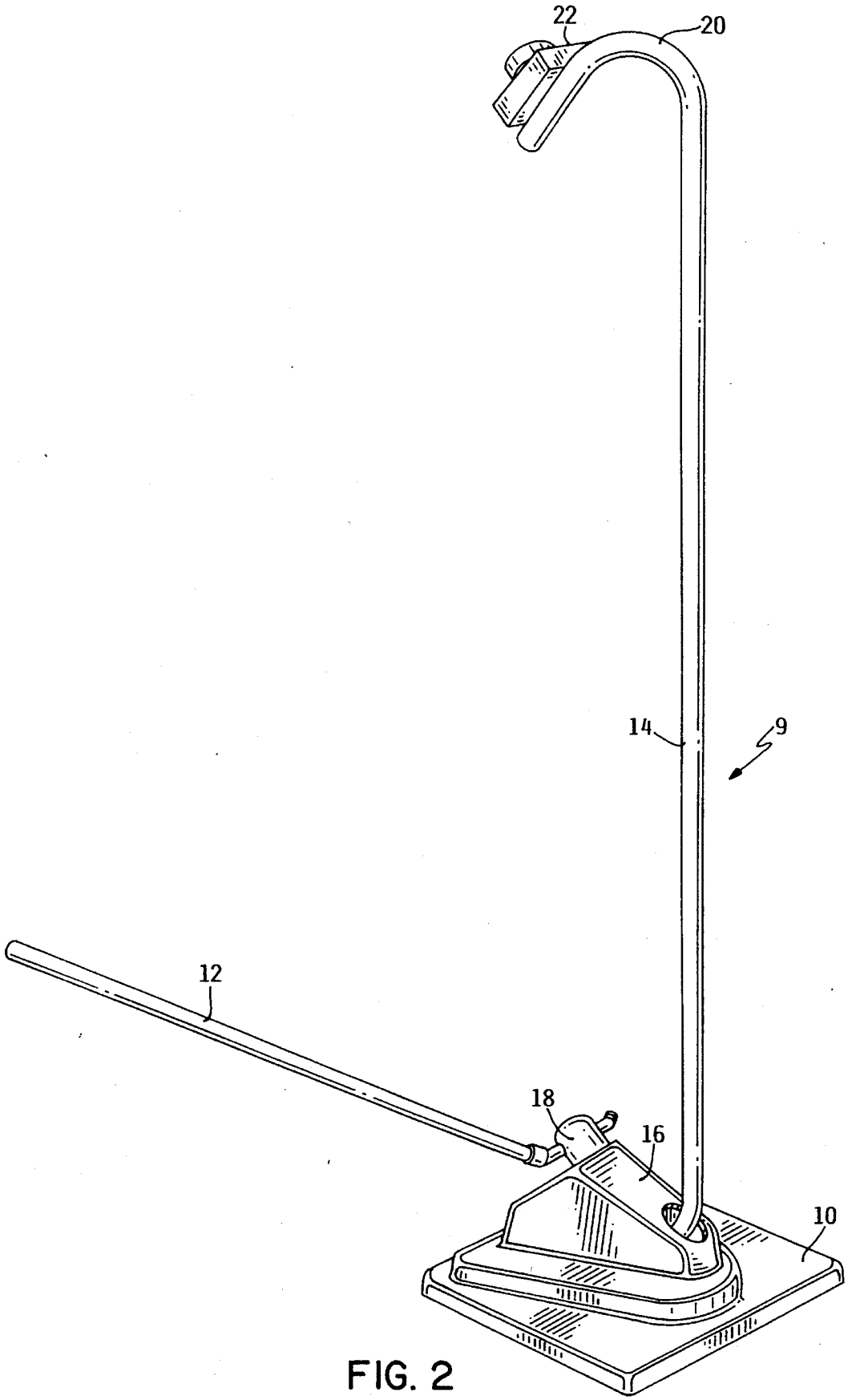
FIG. 2 shows a rear perspective view of the apparatus.

Referring to FIGS. 1 and 2, the sport jump apparatus is shown in perspective views and is generally indicated by the numeral 9. The principal elements shown in these two views consist of a base unit 10, a resilient rod 12 and an upright handle 14. The base unit 10 includes a housing 16. Extending from the housing is a connector portion or hub 18 to which is connected the rod 12. Positioned at the top 20 of the handle 14 is a variable speed control 22.

Figure 3:
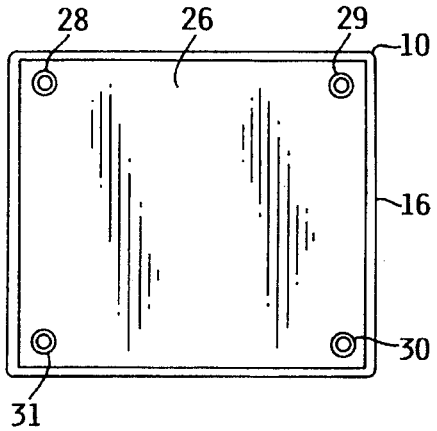
FIG. 3 shows a bottom view of the apparatus.

Referring to FIG. 3, the base unit 10 is shown with the housing 16 engaged with a support base 26. Screws, not shown, or other conventional means may be used to secure the housing to the support base 26. Four rubber feet 28, 29, 30, 31 suitably attached to the support base 26 facilitate placement of the apparatus on a floor.

Figure 4:
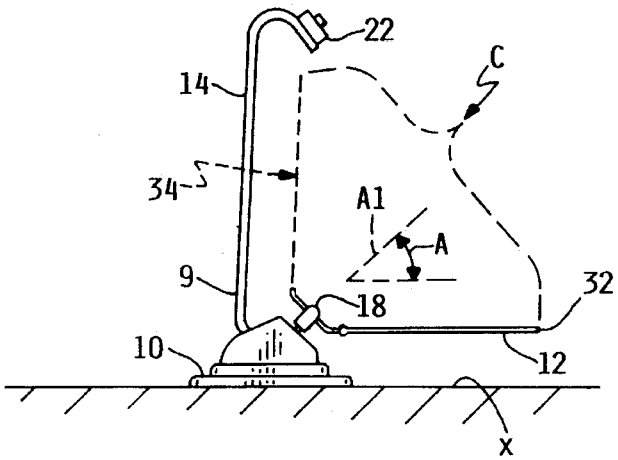
FIG. 4 shows a side elevational view of the apparatus.

Referring to FIG. 4, a side elevational view showing the apparatus placed on a floor 33. The rod 12 is shown in a lower substantially horizontal position designated by the numeral 32, and a substantially vertical position, shown in dashed lines and designated with the numeral 34.

Figure 5:
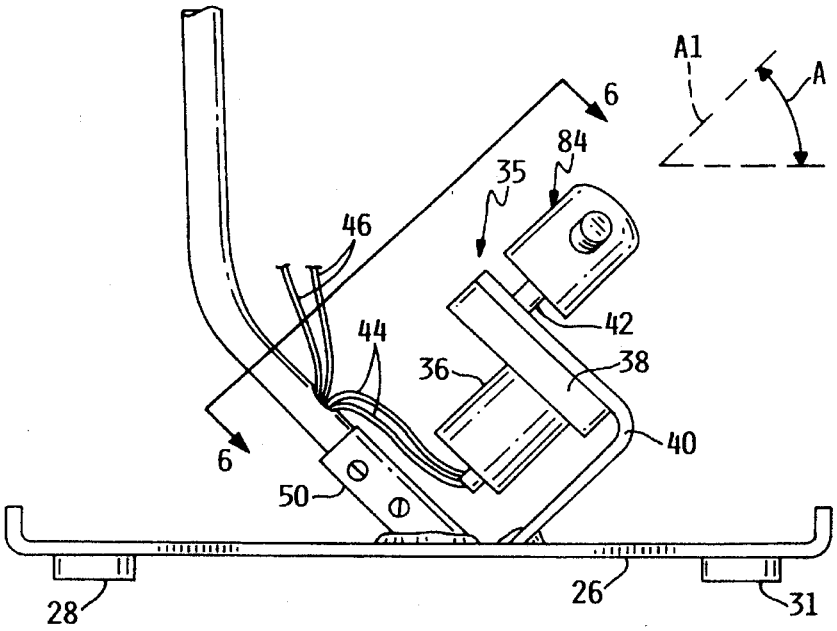
FIG. 5 is a side elevational view of a portion of the apparatus with the housing removed.

Referring to FIG. 5, a side elevation view of the base unit 10 with the housing 16 removed showing the various elements attached to the support base 26. A drive unit 35 is comprised of an electric motor 36 connected to a gear reduction unit 38 which are both supported by a bracket 40. The gear reduction unit 38 has a shaft 42 extending outwardly and through the bracket 50. The bracket 40 is welded or otherwise suitably attached to the support base 26 and is configured such that the shaft 42 extends outwardly at an oblique angle with respect to the support base 26 and floor. As shown in this embodiment the oblique angle is designated by the numeral A and is substantially 45°. The electric motor is powered by a conventional AC or DC power source not shown. The motor is connected to the variable speed control 22 located at the top 20 of the handle 14 by way of wires 44. The additional wires 46 connect to the power supply. The upright handle 14 is also attached to the support base 26 in a suitably configured bracket 40. The support base 26 and the bracket 40 may be conventionally formed from sheet metal or plate stock. The housing 16 may be formed of vacuum molded plastic.

Figure 6:
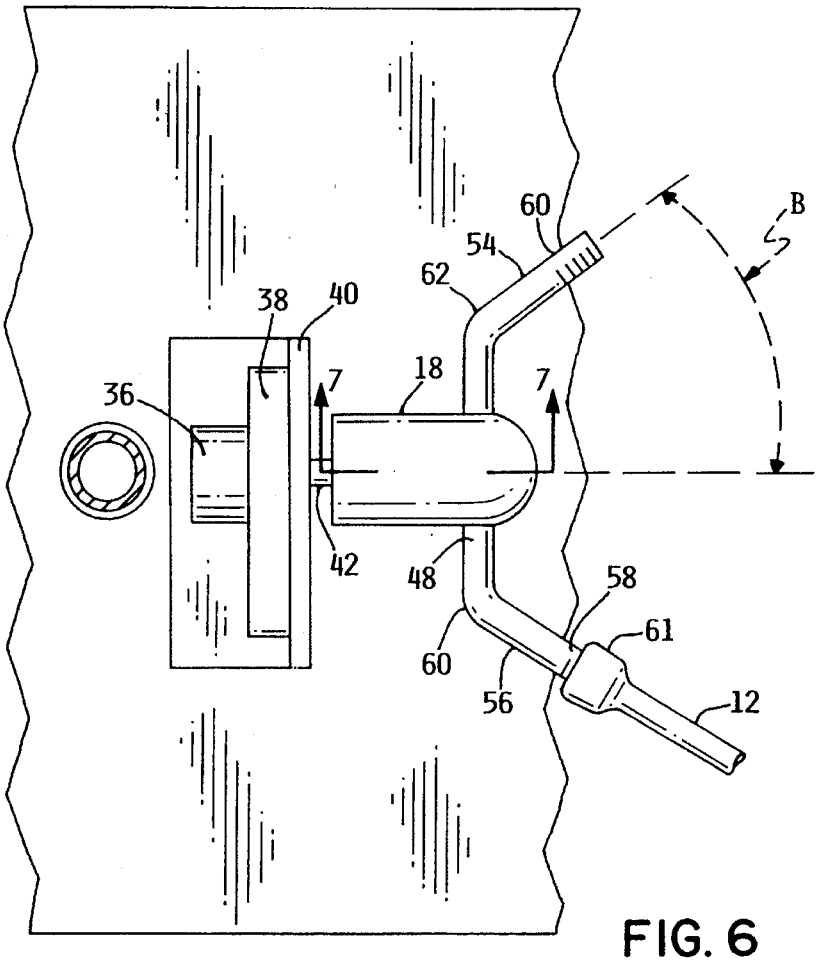
FIG. 6 is a cross-sectional view of a portion of the apparatus taken at line 6—6 of FIG. 5.

Referring to FIG. 6, a partial sectional view taken at plane 6—6 of FIG. 5, shows the motor 36, gear reduction unit 38, the bracket 40, the shaft 42 and the connector portion or hub 18. The connector portion 18 includes an arm member 48 with two arm portions 54, 56. Each arm portion has a bend 62 which angles the end portions 58 at an oblique angle with respect to the shaft axis A1. Said oblique angle is shown by the phantom lines designated by the letter B in FIG. 6. In the embodiment shown, the oblique angle B is substantially 45°. Attached to the end 58 of the arm portion 56 is the resilient rod 12. The resilient rod 12 may be press fit or threadedly attached to the end 58 of the rod 12. The rod 12 has a collar portion 61 which engages said end 58 of the arm member 48. The rod should be sufficiently flexible whereby the rod will bend when it strikes an object. A plastic such as polyvinylchloride is a suitable material for the rod 12. An additional rod, not shown, may be attached to the other arm portion 54. A suitable weight, not shown, may be attached to the arm portion 54 to provide balance with respect to the shaft 42.

Figure 7:
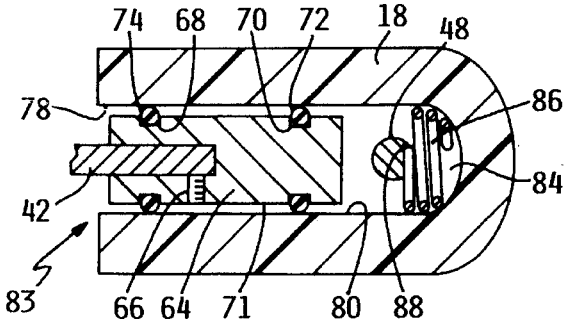
FIG. 7 a cross-sectional view of the connector portion or hub taken at line 7—7 of FIG. 6.

FIG. 7 shows a cross-sectional view of the connector portion or hub 18. The shaft 42, which extends from the gear reducer 38, is nonrotatably connected to a sleeve 64 by way of a conventional means such as a key or set screw 66, as shown in FIG. 7. The sleeve 64 may be suitably formed of steel. The sleeve 64 has two grooves 68, 70 on the exterior 71 of said sleeve 64. Seated in said grooves are O-rings 72, 74. The connector portion 18 has a bore 78 with an interior surface 80. The bore 78 is appropriately sized so that the O-rings 72, 74 contact and engage said inside surface 80. The engagement between the O-rings 72, 74 and the connector portion 18 forms a slip clutch mechanism which is designated generally by the numeral 83. Positioned in the end 84 of the bore 78 is a spring 86 which is compressed and which engages the arm member 48. The arm member 48 has a flattened surface 88 engaged by the spring 86. This engagement functions to resiliently retain the arm member in the appropriate outwardly extending position as shown best in FIG. 6.

The device operates as follows:

Referring to FIGS. 4, 5 and 7, an individual stands on, or in proximity to the exercise position on the floor designated by the letter X. The device is turned on, such as by the variable speed control unit 22, to commence the rotation of the motor 36 of the drive unit 35. Said rotation drives the gear reduction unit 38 and thus the shaft 42. The rotation of the shaft 42 rotates the sleeve 64 and the connector portion or hub 18. Said rotation of the connector portion 18 rotates the arm member 59 and the rod 12. Rotation of rod 12, as shown in FIG. 4, is about the axis A1 of the shaft as opposed to an axial rotation of the rod 12. Said circular rotation forms a conical configuration as designated by the letter C of FIG. 4. As the rod 12 rotates through said conical configuration C, the rod 12 rotates between the lower position 32 and the upper position 34. The individual in the exercise position X is to jump each time the rod 12 rotates around and down through the horizontal jumping position 32. During the exercise, the speed of the rotation and thus the pacing of the exercise can be controlled by adjustment of the speed control unit 22.

The slip clutch 84 and the arm member engaged with the spring 86 provide safety features to prevent any entanglement with the rod 12 or connector portion 18. Additionally, the flexibility of the rod 12 precludes any injury when the rod strikes an individual. When an individual is struck, the apparatus continues to rotate whereby the user may continue the exercise routine without significant disruption.

The speed control unit 22 may be a conventional motor speed control unit. Although the drive unit 12 depicted utilizes an electric motor, alternate motors, such as a spring loaded wind-up motor, a hydraulic motor, or a pneumatic motor also may be used.

Additionally, provisions may be added for varying the jumping height of the rod such as by having the bracket 40 adjustable or by adjusting the feet 28, 29, 30, 31.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A jumping apparatus for an individual comprising:

a) a support base adapted for placement on a substantially horizontal floor surface, b) a drive unit mounted on said support base, the drive unit comprised of a motor and a shaft connecting to and rotated by said motor, the shaft positioned at an oblique angle with respect to the floor surface;

c) an elongate rod for the individual to jump over, the rod connected to the shaft at an oblique angle with respect to said shaft, the rod having a lower substantially horizontal position with the rod extending outwardly beyond the base and an upwardly position with the rod substantially positioned above the base, whereby when the shaft rotates the rod moves between the substantially horizontal position and the upwardly position.

2. The apparatus of claim 1, further comprising a slip clutch for limiting torque provided to the rod, the slip clutch positioned between the rod and the drive nut.

3. The apparatus of claim 1 further comprising a variable speed control for said drive unit.

4. The apparatus of claim 1 further comprising an upright member extending from the support base to a position above the upwardly position of the rod.

5. The apparatus of claim 1, wherein the rotatable shaft extends from the drive unit at an angle of 45°.

6. The apparatus of claim 1, wherein the connector portion connects the rod to the shaft at an angle of substantially 45°.

7. A jumping apparatus of claim 6, wherein the drive unit further comprises an electric motor coupled to a gear reducer.

8. A jump apparatus for use on a floor surface, the apparatus comprising:

a) a support base;

b) a drive unit mounted on said support base, the drive unit comprised of a motor and a shaft extending from the drive unit at an oblique angle with respect to the floor surface, the shaft rotatable by the motor;

c) a straight portion connected to the shaft and extending outwardly therefrom, the straight portion positioned at an oblique angle with respect to said shaft whereby when the shaft rotates the straight portion rotates between a lower substantially horizontal position for jumping over and an upwardly position.

9. The jumping apparatus of claim 8 further comprising a substantially upright handle portion extending from the support base.

10. The jumping apparatus of claim 9 further comprising a variable speed control for the drive unit, the control mounted on the upright handle portion.

11. The jumping apparatus of claim 10, wherein the drive unit is comprised of an electric motor and a gear reducer.

12. The jumping apparatus of claim 11, wherein the straight portion is connected to the rotatable shaft through a slip clutch.

13. The jumping apparatus of claim 12, wherein the shaft extends from the drive unit at substantially 45° with respect to the floor surface.

14. The jumping apparatus of claim 13, wherein the straight portion is connected to the shaft whereby the straight portion is angled at substantially 45° with respect to the shaft.

15. The jumping apparatus of claim 12 further comprised of an additional straight portion connected to the shaft opposite the other straight portion whereby each straight portion rotates between a lower substantially horizontal position for jumping and an upwardly position.

* * * * *